United States Patent [19]

Morris et al.

[11] Patent Number: 5,038,998

[45] Date of Patent: Aug. 13, 1991

[54] TOTE CONTAINER FOR PERISHABLE PRODUCE PARTICULARLY ASPARAGUS

[75] Inventors: Richard J. Morris, Maple Grove; David T. Sarych, Minneapolis; Mark S. Stoll, Deephaven; LeRoy Miller, Minneapolis; Stanley R. Thorud, Brooklyn Center, all of Minn.

[73] Assignee: Liberty Diversified Industries, New Hope, Minn.

[21] Appl. No.: 481,600

[22] Filed: Feb. 16, 1990

[51] Int. Cl.[5] ..... B65D 13/00

[52] U.S. Cl. ..... 229/23 R; 229/112; 229/113; 229/915; 220/4.01; 220/4.28

[58] Field of Search ..... 220/4.28, 4.01; 229/23 R, 112, 114, 113, 164, 915

[56] References Cited

U.S. PATENT DOCUMENTS

| | | | |
|---|---|---|---|
| 2,460,870 | 2/1949 | Bruckhauser | 229/23 R |
| 3,905,541 | 9/1975 | Paxton | 229/23 R |
| 3,935,990 | 2/1976 | Crane | 229/915 |
| 4,105,152 | 8/1978 | Elward | 229/112 |
| 4,304,351 | 12/1981 | Stollberg | 229/23 R |
| 4,347,968 | 9/1982 | Cornell et al. | 229/23 R |
| 4,482,074 | 11/1984 | Lalley | 229/23 R |
| 4,542,847 | 9/1985 | Lindstrom | 229/164 |
| 4,762,270 | 8/1988 | Stolll et al. | 229/DIG. 2 |

*Primary Examiner*—Stephen Marcus
*Assistant Examiner*—Christopher McDonald
*Attorney, Agent, or Firm*—Moore & Hansen

[57] ABSTRACT

A tote container for perishable produce such as asparagus comprising a pair of identical molded end shells which form the side walls of the tote container, with an intermediate blank cut and scored from a sheet material such as double-faced corrugated plastic extending between and securely attached to each of the end shells. The blank is folded to form a bottom panel, back panel, pivoting top lid and front lid panels, and a front tray panel to the tote container. The tote container defines a receptacle region with an open top and front, and the blank defines a bottom tray portion within that receptacle region.

29 Claims, 3 Drawing Sheets

7
8
10
12
14
16
18
20
22
24
26
28
32
34
36
38
40
42
44
46
48
50
52
54
56
58
60
62
64
66
68
70
72
73
74
76
78
80
82
84
86
88
90
92
94
96
100
102
104
106
108
110
112
114
116
G
C

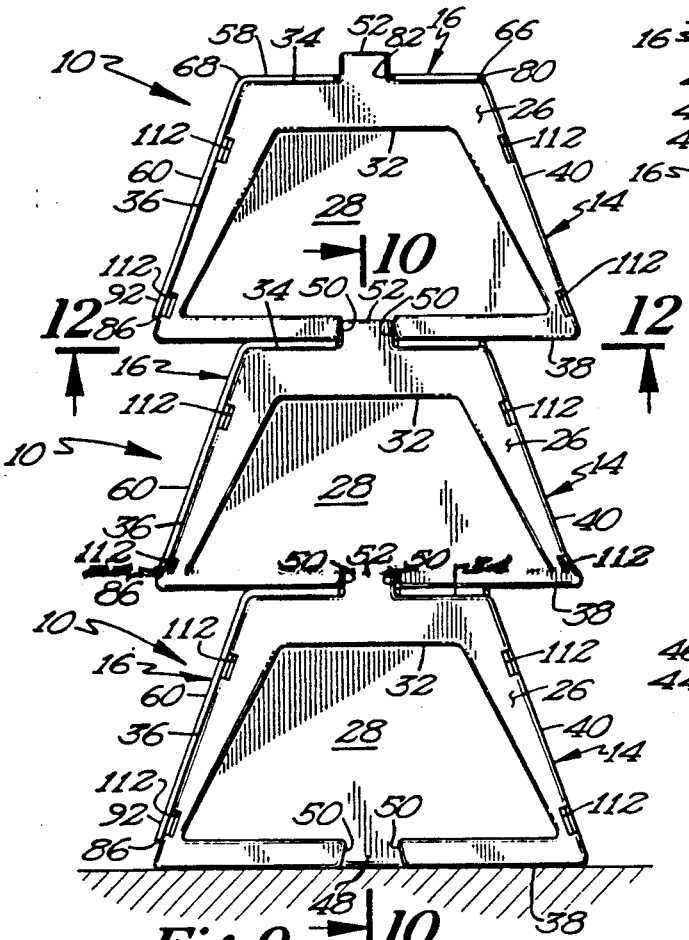
Fig 9
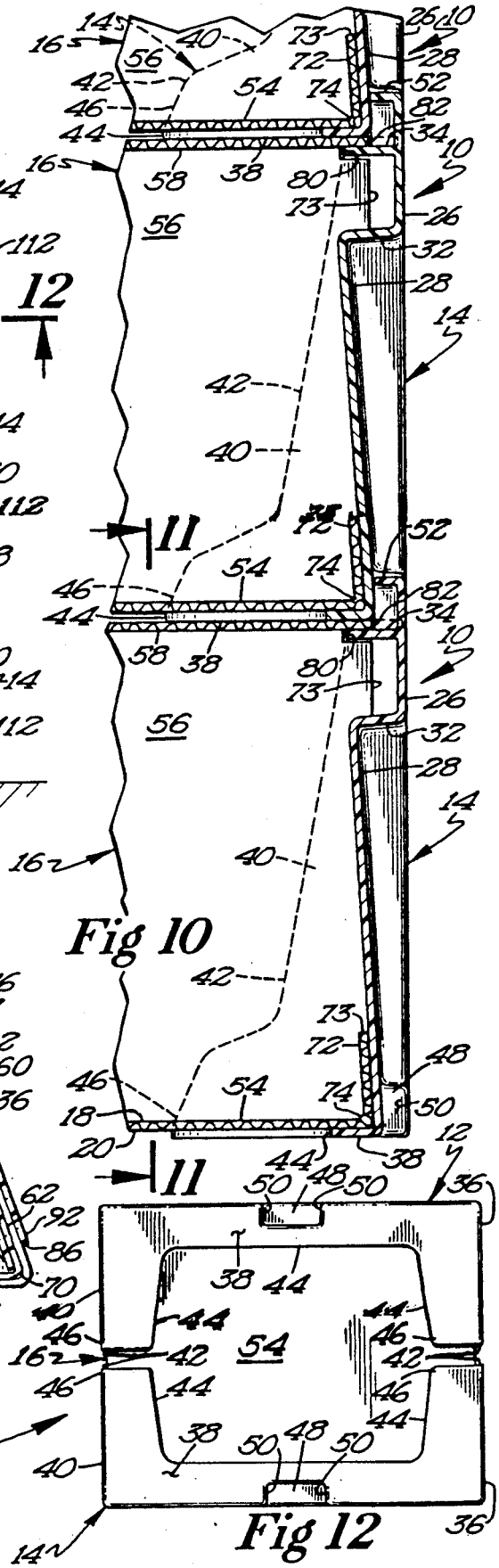
Fig 10
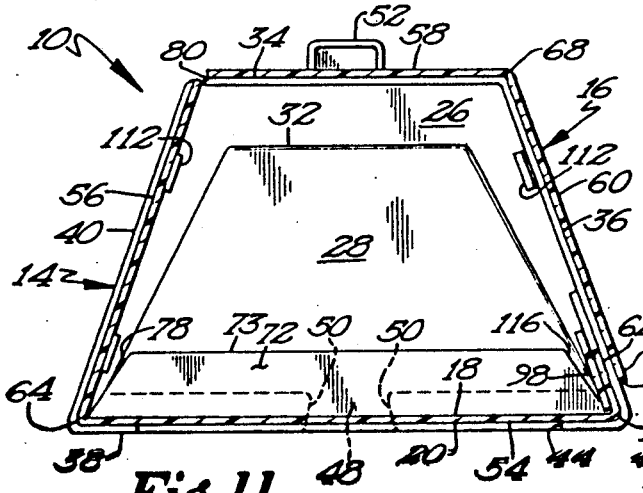
Fig 11
Fig 12

TOTE CONTAINER FOR PERISHABLE PRODUCE PARTICULARLY ASPARAGUS

BACKGROUND OF THE INVENTION

This invention relates generally to tote containers for storing, shipping, or displaying food products, and particularly to a tote container for use in transporting fresh cut asparagus and similar stalk-type vegetables and produce.

While many regions of the United States provide fertile growing conditions for vegetables and other produce, a significant percentage of produce sold and consumed in the United States is grown and imported from foreign countries. As the task of economically growing and selling fresh product is undertaken by larger agricultural concerns rather than local regional growers, the need for more versatile and reusable tote containers for harvesting, shipping, and displaying the produce has become important.

Asparagus is a pertinent example. Asparagus is grown in the states situated along the western coast of the United States, as well as the western coastal regions of Mexico, Central America, and South America. The growing and harvesting periods for the various countries overlap to some extent, but the range of growing periods throughout the coastal regions continues practically throughout the year. Therefore, asparagus is grown and harvested in a repeating yearly cycle extending from the northern coastal states of the United States to the southernmost countries in South America, and companies distributing asparagus to stores and markets within the United States may receive their product from any one of the regions then growing and harvesting asparagus.

Asparagus stalks are currently cut during harvesting, bundled, and placed in large wooden crates. The lids of the crates are nailed shut, and the asparagus or crates may be soaked in or sprayed with cold water. The crates may optionally contain pads or fabric to absorb water and keep the asparagus fresh. Produce such as asparagus will continue to grow after harvesting if the stalks are supplied with water and kept fresh, with growth of as much as 2" in asparagus tips during shipping representing a substantial increase in the quantity and quality of the produce when it arrives at the point of sale. The crates are reopened at a regional distribution center or handling facility, at which the asparagus may be cleaned or sprayed with water, rebundled or packaged, and placed into containers for delivery to individual stores or markets.

BRIEF SUMMARY OF THE INVENTION

It is therefore one object of this invention to design a versatile tote container which may be utilized in the field for directly receiving harvested produce such as asparagus, for shipping that produce over long distances while maintaining its freshness and permitting continued growth, and which may be used to display the produce at a store or market.

It is an additional object of this invention to design the above tote container so that it is constructed from a minimum of similar components and may be quickly and easily assembled in the field without the use of tools or fasteners, and with a minimum of training.

It is another object of this invention to design the above tote container such that stalk-type produce will be retained in a vertical position with the cut stalks submerged in water or in contact with an absorbent pad, thereby maximizing the growth of the produce during shipping.

It is a further object of this invention to design the above tote container such that it may be constructed of inexpensive and lightweight materials to minimize the manufacturing and shipping costs, and such that it may be reused repeatedly to increase the overall economy of the tote container.

It is a related object to design the above tote container such that the unassembled components of a multiplicity of like tote containers may be packaged for transit to the field in an economical manner.

It is yet another object of this invention to design the above tote container such that a plurality of like tote containers may be stacked in a stable vertical column without being crushed, sliding, or being dislodged forward, backward, or to either side relative to one another.

It is a unique object of this invention to design the above tote container such that a plurality of like tote containers may be used to form a useful and attractive point of purchase display for the produce.

Briefly described, the tote container of this invention comprises a pair of identical molded end shells which form the side walls of the tote container, with an intermediate blank cut and scored from a sheet material such as double-faced corrugated plastic extending between and securely attached to each of the end shells. The blank is folded to form a bottom panel, back panel, pivoting top lid and front lid panels, and a front tray panel to the tote container. The tote container defines a receptacle region with an open top and front, and the blank defines a bottom tray portion within that receptacle region.

BRIEF DESCRIPTION OF THE DRAWINGS

FIG. 9 is a side elevation view of three like tote containers of FIG. 1 stacked in vertical column;

FIG. 10 is a cross section view of the right front corners of the stacked tote container of FIG. 9 taken through line 10—10 of FIG. 9;

FIG. 11 is a side cross section view of the center tote container of FIG. 9 taken through line 11—11 of FIG. 10; and FIG. 12 is a bottom view of the tote container of FIG. 1.

DESCRIPTION OF THE PREFERRED EMBODIMENT

The tote container of this invention is shown in FIGS. 1–12 and referenced generally therein by the numeral 10.

Figure 1:
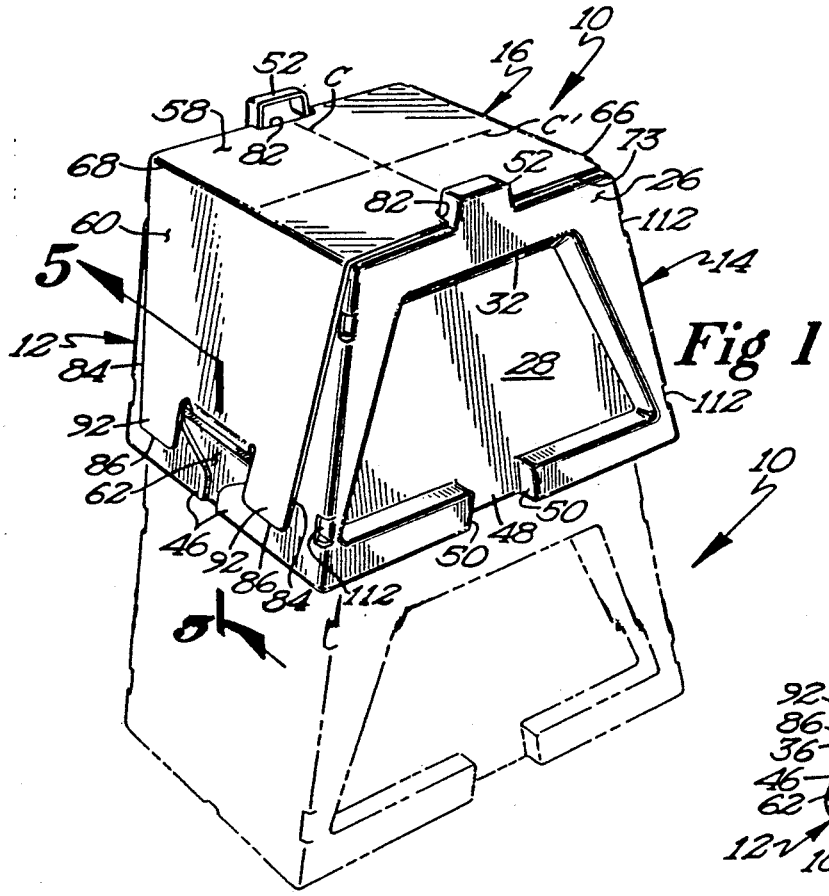
FIG. 1 is a perspective view of the tote container of this invention in the closed position stacked upon a like tote container shown in phantom.
Figure 2:
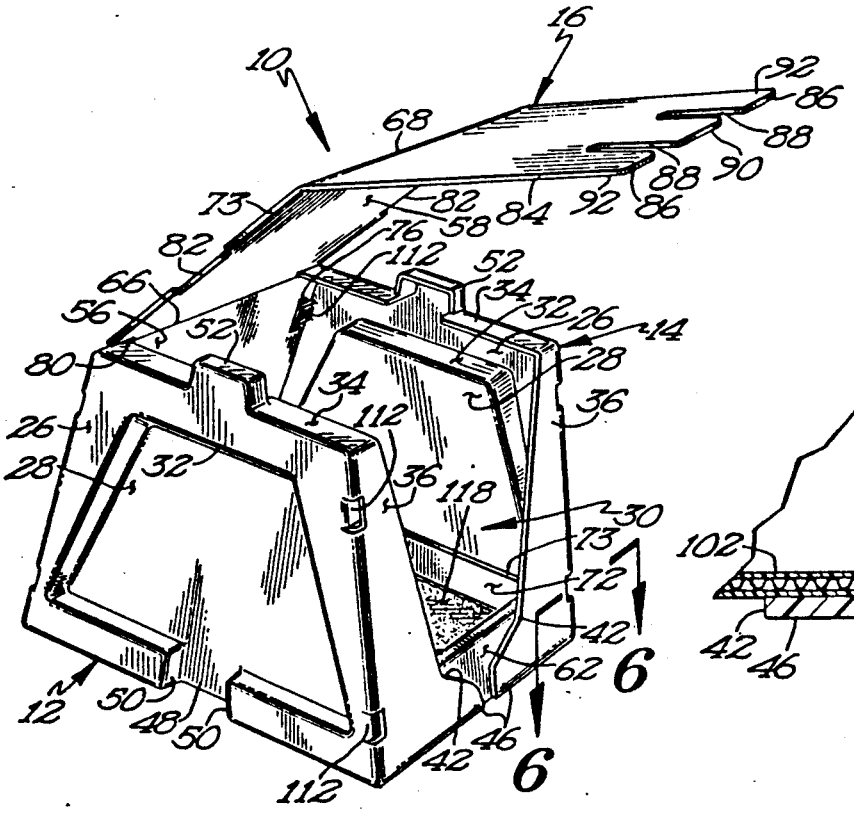
FIG. 2 is a perspective view of the tote container of FIG. 1 in the partially open position.
Figure 6:
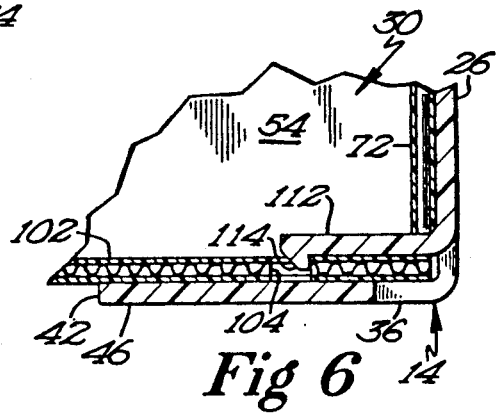
FIG. 6 is a side cross section view of the right front corner of the tote container of FIG. 1 taken through line 6—6 of FIG. 2.
Figures 3, 4, 7, 8:
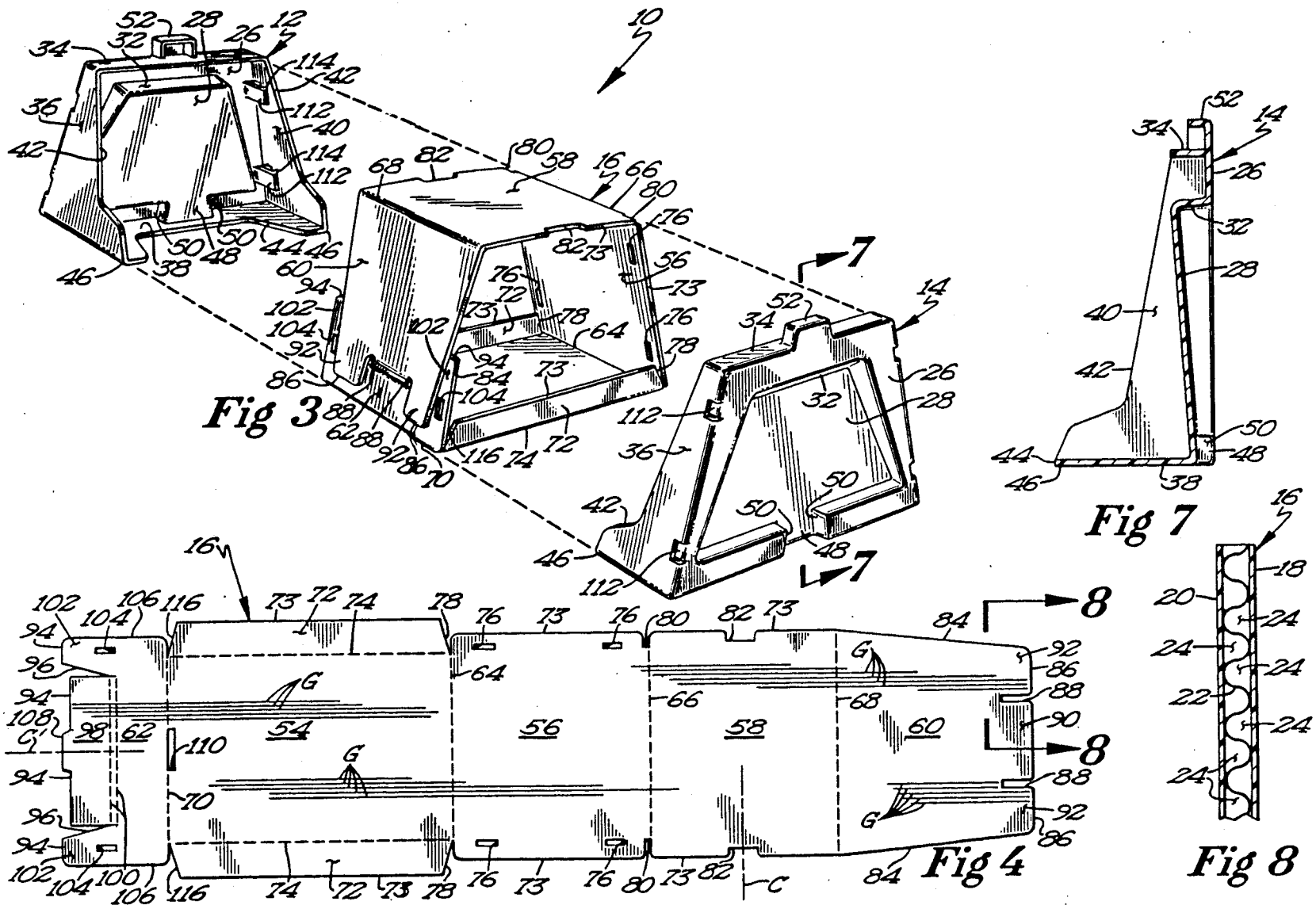
FIG. 3 is an exploded perspective view of the components of the tote container of FIG. 1.
FIG. 4 is a plan view of the intermediate blank of the tote container of FIG. 1.
FIG. 7 is a front cross section view of the right end shell of the tote container of FIG. 1 taken through line 7—7 of FIG. 3.
FIG. 8 is a cross sectional view of the three-ply corrugated plastic sheet material of the intermediate blank taken through line 8—8 of FIG. 4.

Referring particularly to FIGS. 1–3, it may be seen that the tote container 10 is comprised of a first or left end shell 12, a right or second end shell 14, and an intermediate blank 16.

The end shells 12, 14 are molded from a thermoformable plastic such as a lightweight and resilient polystyrene, polyurethane, or polyethylene resin using a conventional blow molding or thermal forming process. The intermediate blank is cut, scored, and folded from a sheet of three-ply, double faced corrugated polyethylene sheet material having a pair of spaced apart planar plies 18, 20, and a convoluted intermediate ply 22 extending therebetween and forming a multiplicity of air spaces 24 which define an internal grain G to the sheet material as shown in FIGS. 4 and 8. Due to variations of manufacturing processes utilized and the tendency of the planar plies 18, 20 to melt together with the intermediate ply 22, the intermediate ply 22 of the sheet material may also take the form of a plurality of generally parallel ribs or beams extending more perpendicularly between the planar plies 18, 20.

Referring again to FIGS. 1–3, the left and right end shells 12, 14 may be seen to be generally symmetrical and identical to one another, although one of the end shells 12, 14 is rotated to face the opposing end shell 14, 12.

Each end shell 12, 14 includes a main side wall section 26 having a generally truncated pyramid shape tapering inwardly from the bottom to the top along both the front and rear edges thereof, as seen particularly in FIGS. 1 and 9. The main side wall sections 26 each define a recessed section or region 28 tapering inwardly toward the receptacle region 30 and lateral centerline C′ of the blank 16 from each side of the tote container 10, and together with the blank 16 the shell sections 12, 14 define a generally or partially open top receptacle region 30 therebetween. The recessed sections 28 taper from the bottom to the top of the side wall sections 26 and have a depth sufficient to form a pair of handgrips 32 disposed on opposing sides of the tote container 10 at the top of each of the recessed sections 28 and proximate to the top of each of the side wall sections 26, as shown in FIGS. 1, 2, and 7.

Each of the side wall sections 26 defines a top, front, bottom, and rear peripheral edge from which extend a top shell section 34, front shell section 36, bottom shell section 38, and rear shell section 40, respectively. Although the junctions or corners between each side wall section 26 and the corresponding top shell section 34, front shell section 36, bottom shell section 38, and rear shell section 40 may be curved or rounded, the top shell sections 34, front shell sections 36, bottom shell sections 38, and rear shell sections 40 should be considered to extend inwardly toward the receptacle region 30 or longitudinal centerline C of the tote container 10 from each the peripheral edges such that each side wall section 26 and the corresponding top shell section 34, front shell section 36, bottom shell section 38, and rear shell section 40 define the outer boundaries of a generally hollow, concave interior region into which the recessed section 28 of the side wall section 26 projects, as shown particularly in FIGS. 2 and 3, and into which the side edges of the intermediate blank 16 are slidably received.

Referring to FIG. 3, it may be seen that the front shell section 36 and rear shell section 40 each taper or narrow outwardly away from the receptacle region 30 or longitudinal centerline C of the tote container 10 as they approach the top front and rear corners of the end shells 12, 14 of the tote container 10, thereby defining an acutely angled edge 42 or cutout.

The bottom shell sections 38 similarly define a recessed edge 44 or cutout extending outwardly from the longitudinal centerline C of the tote container 10 toward the side wall sections 26, such that the bottom shell sections 38 and corresponding front shell section 36 or rear shell section 40 define projecting corner segments 46 along the bottom front and rear corners of the tote container 10.

Referring to FIGS. 3 and 12, the exterior of the side wall sections 26 of each of the left and right end shells 12, 14 define a generally rectangular three-sided opening 48 or gap communicating with the area confined by the recessed sections 28 of the side wall sections 26, each opening 48 being defined by a portion of the side wall section 26 coplanar with the recessed section 28 thereof and a pair of tapered, opposing front and rear surfaces 50 generally perpendicular to the wall of the recessed section 28.

The openings 48 are positioned along the lateral centerline C′ of each of the end shells 12, 14, and are designed to receive and communicate with a pair of correspondingly sized and shaped upwardly projecting shoulders 52 formed in each of the top shell sections 34 and similarly aligned and spaced apart along the lateral centerline C′ of the assembled tote container 10. Each of the projecting shoulders 52 are engagingly received within one of the openings 48 when one of the tote containers 10 is stacked on top of another like tote container as shown in FIG. 9, so that the upper tote container 10 cannot slide or be dislodged forward, backward, or to either side, and may not be rotated in the horizontal plane of the bottom or top of each of the tote containers 10.

Referring to FIG. 4, the intermediate blank 16 is cut and scored to form a plurality of interconnected panels including a bottom panel 54, back panel 56, top lid panel 58, front lid panel 60, and front tray panel 62.

The back panel 56 extends from the rear edge of the bottom panel 54 and is hingedly connected thereto along a single scored fold line 64. The top lid panel 58 extends from the top edge of the back panel 56 and is hingedly connected thereto along a single scored fold line 66. The front lid panel 60 extends from the front edge of the top lid panel 58 and is hingedly connected thereto along a single scored fold line 68. The front tray panel 62 extends from the front edge of the bottom panel 54 and is hingedly connected thereto along a single scored fold line 70. Each of the fold lines 64, 66, 68, 70 connecting the panels 54, 56, 58, 60, 62 being generally longitudinally aligned.

The bottom panel 54 defines a pair of side flaps 72 extending completely along the length of the side edges 73 of the bottom panel 54 and generally parallel thereto, the side tabs being connected to the bottom panel 54 along single scored fold lines 74. The back panel 56 defines four generally rectangular apertures or slots 76 extending completely through the surface thereof, and aligned parallel with the side edges 73 of the back panel 56 and each positioned proximate to one of the four corners of the back panel 56. The side flaps 72 of the bottom panel 54 and edges of the back panel 56 define a pair of angled notches 78 aligned parallel with the score line 64 therebetween and extending inwardly on each side of the blank 16, and the back panel 56 and top lid panel 58 similarly define a pair of generally rectangular notches 80 aligned parallel with the score line 66 therebetween and extending inwardly on each side of the blank 16.

The top lid panel 58 defines a pair of shoulder receiving notches 82 positioned and aligned along the longitudinal centerline C thereof and communicating with the side edges 73 of the top lid panel 58.

The side edges 84 of the intermediate blank 16 along the front lid panel 60 taper or angle inwardly toward the lateral centerline C' of the blank 16 as the side edges 84 extend toward the free end edges 86 thereof. The free edge 86 of the front lid panel 60 defines a pair of generally rectangular, spaced-apart notches 88 which extend inwardly from the free end edge 86 generally perpendicular thereto and parallel to one another, and generally deeper than the rectangular notches 80 along the side edges 73 between the back panel 56 and top lid panel 58. The spaced-apart notches 88 define a first or central securing flap 90 or tab therebetween, and a pair of second or end securing flaps 92 or tabs located on each opposing side of the central securing flap 90.

The end edge 94 of the front tray panel 62 similarly defines a pair of spaced-apart, angled notches 96 extending into the front tray panel 62 from the end edges 94 thereof, thereby forming a front fold-over flap 98 extending from and connected to the top edge of the front tray panel 62 along a double scored fold line 100, and a pair of narrow projecting tabs 102 extending outwardly therefrom. Each of the projecting tabs 102 defines a rectangular slot 104 extending completely therethrough, and aligned parallel with and spaced apart from the side edge 106 thereof a distance generally equal to that of the slots 76 in the back panel 56.

The end edge 94 of the front fold-over flap 98 defines a locking tab 108 having a width corresponding to that of a locking slot 110 defined by and extending at least partially through the bottom panel 54 and oriented generally parallel with and adjacent to the score line 70 between the bottom panel 54 and the front tray panel 62.

Referring again to FIGS. 2, 3, and 6, it may be seen that the left and right end shells 12, 14 each include four securing clips 112 which extend inwardly from the side walls 26 thereof, two of the securing clips 112 each closely confronting and parallel with one of the front shell section 36 and rear shell section 40 of each of the end shells 12, 14 and defining a gap equal to or slightly greater than the thickness of the corrugated plastic sheet material measured between the planar plies 18, 20. Each securing clip 112 has a length measured from the corresponding side wall section 26 generally equal to the distance the rectangular slots 76, 104 are spaced from the corresponding side edges 73, 106 of the back panel 56 or front tray panel 62. Each securing clip 112 defines an angled tang or hook member 114 extending toward the closely confronting front shell section 36 or rear shell section 40, respectively, with the angled surface of the hook member 114 being positioned facing the lateral centerline C' of the tote container 10 and the oblique or right angled surface of the hook member 112 facing the side wall section 26 of the end shell 12, 13. The securing clips 112 are preferably spaced apart near the top and bottom of the end shells 12, 14 of the tote container 10, although the number of securing clips 112 may alternately be increased, or may be located at other positions depending upon the stresses and loads on the tote container 10 and the materials selected. The securing clips 112 may also comprise an elongated projecting rim or similar retaining members extending completely or partially along any of the front, bottom, back, and to shell sections 34, 36, 38, 40 and communicating with elongated slots or grooves along the side edges 73, 106 of the intermediate blank 16, so that the components of the tote container assembly 10 may be securely fastened together with at least one clip 112 and slot combination per end shell 12, 14.

Referring to FIGS. 2 and 3, it may be seen that to assemble the tote container 10, the intermediate blank 16 is first folded to a partially folded position as shown in FIG. 2, or a completely folded position as shown in FIG. 3.

Figure 5:
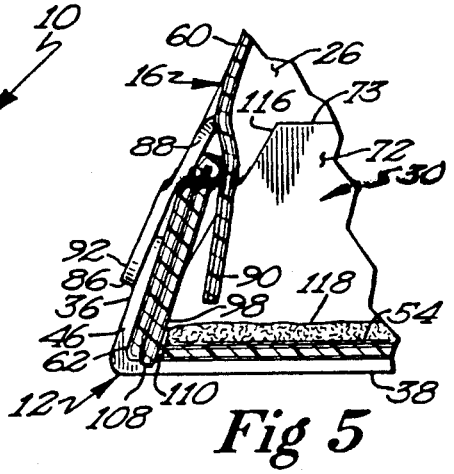
FIG. 5 is a side cross section view of the front center of the tote container of FIG. 1 taken through line 5—5 of FIG. 1.

The side flaps 72 of the bottom panel 54 are folded upwardly and inwardly across the fold lines 74 toward the lateral centerline C' of the blank 16 to a position generally perpendicular to the bottom panel 54 to form the sides of a bottom tray portion of the tote container 10. The front tray panel 62 is folded upwardly and rearwardly relative to the bottom panel 54 across the fold line 70 and into contact with the angled front edges 116 of the side flaps 72, and the front fold-over flap 98 is folded rearwardly and downwardly across the double scored fold lines 100 relative to the front tray panel 62 and between the side flaps 72 until the locking tab 108 engages in the locking slot 110 of the bottom panel 54 to form the front of the bottom tray portion of the tote container 10, the front fold-over flap 98 making parallel abutting contact with the interior side of the front tray panel 62. The back panel 56 is folded upwardly and forwardly across the fold line 65 to an acute angle relative to the bottom panel 54 and into contact with the angled rear edges of the side flaps 72 defined by the notches 78, thereby forming the rear of the bottom tray portion of the tote container 10. The top lid panel 58 is folded forwardly across the fold line 66 until the planar surfaces of the top lid panel 58 are generally horizontal and parallel with the bottom panel 54. The front lid panel 60 may optionally be folded downward across the fold line 68 with the central securing flap 90 being tucked inwardly behind the front tray panel 62 and front foldover panel 98 as shown in FIG. 5 to hold the folded blank 16 in position, although this may interfere with attaching the end shells 12, 14 to the intermediate blank 16.

One of the end shells 12, 14 is positioned on each of the left and right sides of the folded blank 16 and oriented facing the other opposing end shell 14, 12. The front tray panel 62, bottom panel 54, and back panel 56 are then slidably received within a first and then within a second of the end shells 12, 14 with the outer planar surface of the projecting tabs 102 of the front tray panel 62 closely confronting and contacting the inner planar surfaces of the front shell sections 36 of the end shells 12, 14, the bottom of outer planar surface of the back panel 56 closely confronting and contacting the inner surfaces of the rear shell sections 40.

The front tray panel 62, bottom panel 54, and back panel 56 of the intermediate blank 16 continue to be pressed into the interior regions of the end shells 12, 14 until the front tray panel 62, bottom panel 54, and back panel 56 contact the inner surfaces of the side wall sections 26 of the end shells 12, 14, and the hook members 114 of three of the securing clips 112 securely engage within the slots 76, 104 of the back panel 56 and front tray panel 62, with the back panel 56 and front tray panel positioned between the securing clips 112 and the corresponding front shell section 36 or rear shell section 40. The top lid panel 58 should remain on the exterior side or above the top shell sections 34 of the end shells 12, 14, such that the top lid panel 58 may be pivoted from an open or raised position disposed above the assembled tote container 10 downwardly to a closed position substantially covering the open top of the tote container 10 and contacting the outer or upper planar surfaces of the top shell sections 34, with each of the projecting shoulders 52 being received within one of the shoulder receiving notches 82 and the top lid panel 58 disposed between the projecting shoulders 52. Prior to the top lid panel 58 being folded downwardly into contact with the upper planar surfaces of the top shell sections 34, the front lid panel 60 should be folded downwardly and backwardly and the central securing flap 90 of the front lid panel 60 should be pressed inwardly toward the receptacle region 30 and the longitudinal centerline 0 of the tote container 10 so that the central securing flap 90 may be received and engage behind the interior side of the front tray panel 62 and front foldover panel 98 as the top lid panel 58 is folded downwardly into contact with the upper planar surfaces of the top shell sections 34 to enclose the receptacle region 30, the end securing tabs 92 being disposed on the exterior side of the front tray panel 62. The central securing flap 90 and end securing tabs 92 are thereby disposed on opposing sides of the front tray panel 62 and front foldover panel 98, and exert a scissoring force thereon to hold and secure the front lid panel 60 and top lid panel 58 in the completely closed position as shown in FIGS. 1 and 11.

In operation, the components for a multiplicity of the tote containers 10 can be transported to the harvesting field with the end shells 12, 14 stacked together, and the intermediate blanks 16 laid flat in a stack and secured or bound together.

The tote container 10 is assembled in the field or close to the harvesting site as described above, and an absorbent pad 118 may be inserted into the tote container 10 and positioned covering the bottom panel 54. The asparagus or other produce which as been recently harvested is placed in the tote container 10 with the freshly cut stems or stalks oriented generally perpendicular to and contacting the pad 118 on the bottom panel 54, and the bottom tray portion of the tote container 10 is filled with cold fresh water. The rate at which the water will drain from the bottom tray portion of the tote container 10, and the amount of water retained by the pad 118, will be determined by the materials and tolerances of the blank 16 and end shells 12, 14. The front lid panel 60 and top lid panel 58 of the loaded tote container 10 are then closed, and several like tote containers 10 may be stacked in a vertical column as described above and as shown in FIGS. 9 and 10. The loaded tote containers 10 may then be transported to a location at which the produce will be sold, water being added to the pad 118 when necessary, and the front lid panel 60 and top lid panel 58 folded upwardly to open the tote container 10 and display the produce for sale.

The interior and exterior surfaces of the intermediate blank 16, particularly the front lid panel 60 and top lid panel 58, as well as the exterior surfaces of the end shells 12, 14 may be printed or silk-screened with promotional, advertising, or product information, or the resins for the various components dyed to attain a desired ornamental appearance or color combination.

While the preferred embodiment of the above tote container 10 of this invention has been described in detail with reference to the attached drawing figures, it is understood that various changes and adaptions may be made in the tote container 10 without departing from the spirit and scope of the appended claims.

What is claimed is:

1. A tote container assembly for constructing a tote container defining a receptacle region having at least a partially open top and at least a partially open front, the tote container assembly comprising:

a first end shell defining a first side wall and a second end shell spaced apart from said first end shell and defining a second end wall; and an intermediate blank extending between and fastenable to each of the first and the second end shells, the intermediate blank being scored and folded to define a plurality of panels, said panels defining at least a bottom portion, a back portion, a front portion, and a lid portion of the tote container for enclosing the receptacle region, the panels of the intermediate blank including a bottom panel having a front edge and a rear edge, a back panel extending from and hingedly connected to the bottom panel along the rear edge thereof, the back panel having a top edge, a front tray panel extending from and hingedly connected to the bottom panel along the front edge thereof, a top lid panel extending from and hingedly connected to the back panel along the top edge thereof, the top lid panel having a front edge, and a front lid panel extending from and hingedly connected to the front edge of the top lid panel, the front lid panel being movable with the top lid panel between the open position and the closed position, the front lid panel generally covering the open front of the tote container when the front lid panel is in the closed position; and means for securely attaching the first end shell and the second end shell to the intermediate blank.

2. The tote container assembly of claim 1 wherein the first end shell and the second end shell are constructed from a molded plastic.

3. The tote container assembly of claim 2 wherein the plastic is a polystyrene.

4. The tote container assembly of claim 1 wherein the intermediate blank is constructed from a double faced corrugated plastic sheet material.

5. The tote container of claim 4 wherein the double faced corrugated plastic sheet material is a polyethylene.

6. The tote container assembly of claim 1 wherein the bottom panel is disposed in a generally horizontal position when the tote container is assembled, and wherein the back panel is folded upwardly relative to the bottom panel and forms a generally acute angle therewith, the front tray panel is folded upwardly relative to the bottom panel and forms a generally acute angle therewith, and wherein the top lid panel may be selectively moved between a raised position disposed above the open top and a closed position substantially covering the open top.

7. The tote container assembly of claim 1 wherein the front lid panel has a free edge, the free edge defining at least one securing tab, the securing tab engaging the front tray panel when the top lid panel and the front lid panel are moved to the closed position.

8. The tote container assembly of claim 7 wherein the front tray panel has an interior side facing the receptacle region and an exterior side opposing the receptacle region, and wherein the number of securing tabs is at least two, a first of the securing tabs being selectively disposed on the interior side of the front tray panel and a second of the securing tabs being selectively disposed on the exterior side of the front tray panel when the front lid panel is moved to the closed position.

9. The tote container assembly of claim 8 wherein the number of first securing tabs is one and the number of second securing tabs is two, the first securing tab being disposed between the second securing tabs and separated therefrom by a pair of notches extending into the top lid panel from the free edge thereof.

10. The tote container assembly of claim 1 wherein the bottom panel includes a pair of opposing side edges, the tote container assembly further comprising:

a pair of side flaps, each side flap extending from and hingedly connected to the bottom panel along one of the opposing side edges thereof.

11. The tote container of claim 10 wherein the bottom panel is disposed in a generally horizontal position when the tote container is assembled, and wherein the back panel is folded upwardly relative to the bottom panel and forms a generally acute angle therewith, the front tray panel is folded upwardly relative to the bottom panel and forms a generally acute angle therewith, and the pair of side flaps are each folded upwardly relative to the bottom panel and form a generally perpendicular angle therewith, such that the bottom panel, the back panel, the front tray panel, and the side flaps form a tray portion of the tote container.

12. The tote container assembly of claim 1 wherein the front tray panel has a top edge and includes a front foldover flap extending from and hingedly connected to the front tray panel along the top edge thereof.

13. The tote container assembly of claim 12 wherein the front tray panel has an interior side and the front foldover flap is folded relative to the front tray panel into a generally parallel abutting contact with the interior side of the front tray panel when the tote container is assembled.

14. The tote container of claim 13 wherein the front foldover flap defines a locking tab and the bottom panel defines a locking slot, the locking tab being at least partially received within the locking slot when the front foldover flap is folded into generally parallel abutting contact with the interior side of the front tray panel.

15. A tote container assembly for constructing a tote container defining a receptacle region having at least a partially open top, the tote container assembly comprising:

a first end shell defining a first side wall and a second end shell spaced apart from said first end shell and defining a second end wall, each of the first and the second end shells including a main side wall section oriented generally vertically when the tote container is assembled, each of the first and the second end shells including a recessed section, each recessed section being defined by at least a portion of the main side wall section of the first and the second end shells and extending inwardly toward the intermediate blank, each recessed section defining a handgrip, an intermediate blank extending between and fastenable to each of the first and the second end shells, the intermediate blank being scored and folded to define a plurality of panels, said panels defining at least a bottom portion, a back portion, a front portion, and a lid portion of the tote container for enclosing the receptacle region; and means for securely attaching the first end shell and the second end shell to the intermediate blank

16. The tote container assembly of claim 15 wherein each of the first and the second end shells includes a top shell section connected to the main side wall section generally perpendicularly thereto and extending inwardly toward the intermediate blank, a front shell section connected to the main side wall section generally perpendicularly thereto and extending inwardly toward the intermediate blank, a bottom shell section connected to the main side wall section generally perpendicularly thereto and extending inwardly toward the intermediate blank, and a rear shell section connected to the main side wall section generally perpendicularly thereto and extending inwardly toward the intermediate blank.

17. The tote container assembly of claim 15 wherein each of the first and the second end shells includes a main side wall section oriented generally vertically when the tote container is assembled, a top shell section connected to the main side wall section generally perpendicularly thereto and extending inwardly toward the intermediate blank, and wherein each of the handgrips is positioned proximate to the top shell section of the corresponding main side wall section and is generally parallel therewith.

18. The tote container assembly of claim 15 wherein each of the main side wall sections has a generally truncated pyramid shape, the main side wall sections each having a front edge and a back edge and a bottom edge and a top edge, the front edge and the back edge tapering toward one another as the front edge and the back edge extend upwardly from the bottom edge to the top edge.

19. A tote container assembly for constructing a tote container defining a receptacle region having at least a partially open top, the tote container assembly comprising:

a first end shell defining a first side wall and a second end shell spaced apart from said first end shell and defining a second end wall; and an intermediate blank extending between and fastenable to each of the first and the second end shells, the intermediate blank being scored and folded to define a plurality of panels, said panels defining at least a bottom portion, a back portion, a front portion, and a lid portion of the tote container for enclosing the receptacle region; and means for securely attaching the first end shell and the second end shell to the intermediate blank, including a plurality of securing clips, at least one of the securing clips being connected to the first end shell and projecting inwardly therefrom toward the intermediate blank when the tote container is assembled, and at least one of the securing clips being connected to the second end shell and projecting inwardly therefrom toward the intermediate blank when the tote container is assembled, the intermediate blank defining a plurality of securing slots extending at least partially therethrough, each of the securing clips engaging at least one of the slots to secure the first end shell and the second end shell to the intermediate blank.

20. The tote container of claim 19 wherein each of the first and the second end shells includes four securing clips, the back panel of the intermediate blank defining four securing slots and the front tray panel of the intermediate blank defining two securing slots, two of the securing clips of each of the end shells each engaging two of the securing slots in the back panel, and one of the securing clips of the end shells each engaging one of the securing slots in the front tray panel.

21. The tote container assembly of claim 19 wherein two of the plurality of securing clips are disposed proximate to the back portion of the intermediate panel and at least one of the plurality of securing clips is disposed proximate to the front portion of the intermediate blank.

22. The tote container assembly of claim 19 wherein each of the first and the second end shells includes a main side wall section oriented generally vertically when the tote container is assembled, a top shell section connected to the main side wall section generally perpendicularly thereto and extending inwardly toward the intermediate blank, a front shell section connected to the main side wall section generally perpendicularly thereto and extending inwardly toward the intermediate blank, a bottom shell section connected to the main side wall section generally perpendicularly thereto and extending inwardly toward the intermediate blank, each of the front shell section, bottom shell section, and rear shell section having an inner surface.

23. The tote container of claim 22 wherein the front tray panel, bottom panel, and back panel are slidably received within the first and the second of the end shells with the outer planar surface of the front tray panel closely confronting and contacting the inner surface of the front tray panel closely confronting and contacting the inner surface of the front shell section of the end shells, the outer surface of the bottom panel closely confronting and contacting the inner surface of the bottom shell section of the end shells, and the outer surface of the back panel closely confronting and contacting the inner surface of the rear shell section of the end shells.

24. The tote container of claim 19 wherein each of the end shells defines at least one stacking shoulder projecting upwardly therefrom.

25. The tote container assembly of claim 24 wherein the top lid panel defines a pair of shoulder receiving notches, each of the stacking shoulders being received within one of the shoulder receiving notches when the top lid panel is moved to the closed position such that the top lid panel is at least partially disposed between the stacking shoulders.

26. The tote container assembly of claim 25 which may be stacked vertically on top of a like tote container, and wherein each of the first and the second end shells includes a main side wall section oriented generally vertically when the tote container is assembled and defining a recessed section, each recessed section extending inwardly toward the intermediate blank, and wherein the main side wall section defines an opening having an open bottom, the stacking shoulders of the like tote container is stacked on top of the like tote container.

27. The tote container assembly of claim 25 wherein each of the openings defined by the corresponding main side wall section has three sides.

28. The tote container assembly of claim 25 wherein each of the openings defined by the corresponding main side wall section communicates with the recessed region of the corresponding main side wall section.

29. A tote container defining a receptacle region having a generally open top and a generally open front, the tote container comprising:

a first end shell defining a first side wall of the tote container and a second end shell spaced apart from said first end shell and defining a second wall of the tote container, each of the first and the second end shells includes a main side wall section oriented generally vertically when the tote container is assembled, a top shell section connected to the main side wall section generally perpendicularly thereto and extending inwardly toward the intermediate blank, a front shell section connected to the main side wall section generally perpendicularly thereto and extending inwardly toward the intermediate blank, a bottom shell section connected to the main side wall section generally perpendicularly thereto and extending inwardly toward the intermediate blank, each of the front shell section, bottom shell section, and rear shell section having an inner surface and an exterior surface; and an intermediate blank extending between and connected to each of the first and second end shells, the intermediate blank being scored and folded to define a plurality of panels including a bottom panel, a front tray panel, a back panel, and a top lid panel and a front lid panel each movable between an open position and a closed position covering the generally open top and the open front of the receptacle region, the back panel and the bottom panel being disposed in close confronting relation to the inner surface of the rear wall section and the bottom wall section, respectively, and the top lid panel and the front lid panel being disposed in close confronting relation to the exterior surface of the top shell section and front shell section, respectively.

* * * * *

UNITED STATES PATENT AND TRADEMARK OFFICE

CERTIFICATE OF CORRECTION

PATENT NO. : 5,038,998

DATED : 8/13/91

INVENTOR(S) : Richard J. Morris, David T. Sarych, Mark S. Stoll, LeRoy Miller Stanley R. Thorud

It is certified that error appears in the above-identified patent and that said Letters Patent is hereby corrected as shown below:

In column 7, line 25, delete "O" and replace with --C--.

Signed and Sealed this

Twenty-second Day of December, 1992

*Attest:*

DOUGLAS B. COMER

*Attesting Officer*

*Acting Commissioner of Patents and Trademarks*